US005163867A

United States Patent [19]

Rasmussen

[11] Patent Number: 5,163,867

[45] Date of Patent: Nov. 17, 1992

[54] DISC-TYPE COIN SORTER WITH MULTIPLE-PATH QUEUING

[75] Inventor: James M. Rasmussen, Chicago, Ill.

[73] Assignee: Cummins-Allison Corp., Mt. Prospect, Ill.

[21] Appl. No.: 700,454

[22] Filed: May 15, 1991

[51] Int. Cl.[5] ..... G07D 3/00

[52] U.S. Cl. ..... 453/10

[58] Field of Search ..... 453/6, 10, 32

[56] References Cited

U.S. PATENT DOCUMENTS

| | | | |
|---|---|---|---|
| 4,086,928 | 5/1978 | Ristvedt . | |
| 4,098,280 | 6/1978 | Ristvedt . | |
| 4,506,685 | 3/1985 | Childers et al. . | |
| 4,543,969 | 10/1985 | Rasmussen | 453/10 |
| 4,549,561 | 10/1985 | Johnson et al. | 453/10 |
| 4,557,282 | 12/1985 | Childers et al. . | |
| 4,564,036 | 1/1986 | Ristvedt . | |
| 4,564,037 | 1/1986 | Childers et al. . | |
| 4,570,655 | 2/1986 | Raterman | 453/32 X |
| 4,607,649 | 8/1986 | Taiple et al. . | |
| 4,681,128 | 7/1987 | Ristvedt et al. . | |
| 4,731,043 | 3/1988 | Ristvedt | 453/6 |
| 4,775,353 | 10/1988 | Childers et al. . | |
| 4,775,354 | 10/1988 | Rasmussen | 453/10 |
| 4,863,414 | 9/1989 | Ristvedt et al. . | |
| 4,921,463 | 5/1990 | Primdahl et al. . | |
| 4,966,570 | 10/1990 | Ristvedt et al. | 453/6 |
| 5,009,627 | 4/1991 | Rasmussen | 453/10 |
| 5,011,455 | 4/1991 | Rasmussen | 453/32 |
| 5,026,320 | 6/1991 | Rasmussen . | |

*Primary Examiner*—F. J. Bartuska

*Attorney, Agent, or Firm*—Arnold, White & Durkee

[57] ABSTRACT

A coin sorter which includes a rotatable disc, a drive motor for rotating the disc, and a stationary sorting head having a lower surface parallel to the upper surface of the rotatable disc and spaced slightly therefrom, the lower surface of the sorting head forming a channel for receiving coins passing beneath the inner edge of the sorting head and guiding those coins as the coins are carried along the lower surface of the sorting head by the rotating disc. The channel has an outer wall which extends outwardly away from the center of rotation of the disc, and then returns inwardly toward the center of rotation for a short distance before terminating, and an inner wall which converges toward the outer wall in the region where the outer wall returns toward the center of rotation. In preferred embodiments, the radius of the inner wall from the center of rotation increases in the direction of coin movement, and then remains constant to merge with the returning portion of the outer wall; the inner wall is beveled to allow coins to be forced under that wall; the region adjacent the inner wall in the region where the inner and outer walls converge is relieved to receive the inner portions of coins having a diameter greater than the distance between the inner and outer walls; and/or the inner and outer walls converge to a minimum radial spacing that is substantially equal to the diameter of the smallest-diameter coin having a thickness greater than the vertical distance between the disc and the ceiling of the channel.

5 Claims, 12 Drawing Sheets

DISC-TYPE COIN SORTER WITH MULTIPLE-PATH QUEUING

FIELD OF THE INVENTION

The present invention relates generally to coin sorting devices and, more particularly, to coin sorters of the type which use a resilient disc rotating beneath a stationary sorting head for sorting coins of mixed denominations.

SUMMARY OF THE INVENTION

It is a primary object of the present invention to provide an improved coin sorter which is capable of processing a wide variety of different coin sizes, e.g., the coin sets of different countries, without any significant changes in accuracy or throughput rate.

Another related object of the invention is to provide such an improved coin sorter which facilitates the alignment of coins of mixed denominations in a single layer and in single file.

It is another important object of this invention to provide an improved coin sorter which increases the throughput rate of coins processed by the sorter.

A further object of this invention is to provide an improved coin sorter which improves the separation of coins which are stacked on or overlap each other.

In accordance with the present invention, the foregoing objectives are realized by providing a coin sorter which includes a rotatable disc, a drive motor for rotating the disc, and a stationary sorting head having a lower surface parallel to the upper surface of the rotatable disc and spaced slightly therefrom, the lower surface of the sorting head forming a channel for receiving coins passing beneath the inner edge of the sorting head and guiding those coins as the coins are carried along the lower surface of the sorting head by the rotating disc. The channel has an outer wall which extends outwardly away from the center of rotation of the disc, and then returns inwardly toward the center of rotation for a short distance before terminating, and an inner wall which converges toward the outer wall in the region where the outer wall returns toward the center of rotation. In preferred embodiments, the radius of the inner wall from the center of rotation increases in the direction of coin movement, and then remains constant to merge with the returning portion of the outer wall; the inner wall is beveled to allow coins to be forced under that wall; the region adjacent the inner wall in the region where the inner and outer walls converge is relieved to receive the inner portions of coins having a diameter greater than the distance between the inner and outer walls; and/or the inner and outer walls converge to a minimum radial spacing that is substantially equal to the diameter of the smallest-diameter coin having a thickness greater than the vertical distance between the disc and the ceiling of the channel.

Other objects and advantages of the invention will be apparent from the following detailed description and the accompanying drawings.

DESCRIPTION OF THE PREFERRED EMBODIMENTS

Figure 1:
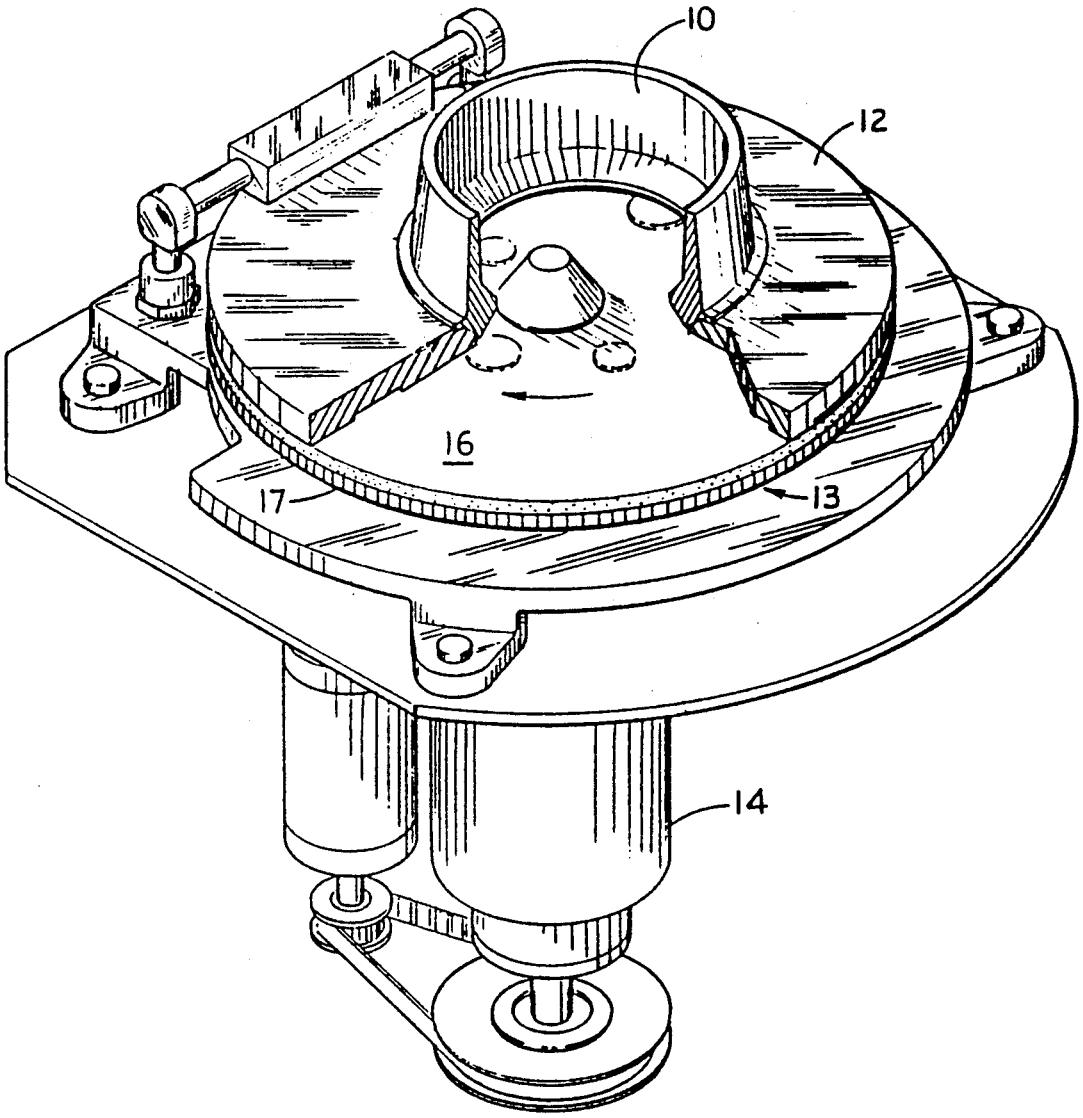
FIG. 1 is perspective view of a coin sorter embodying the present invention, with portions thereof broken away to show the internal structure.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings and referring first to FIG. 1, a hopper 10 receives coins of mixed denominations and feeds them through a central feed aperture in an annular sorting head or guide plate 12. As the coins pass through the feed aperture, they are deposited on the top surface of a rotatable disc 13. This disc 13 is mounted for rotation on a stub shaft (not shown) and driven by an electric motor 14 attached to a mounting plate 15. The disc 13 comprises a resilient pad 16, preferably made of a resilient rubber or polymeric material, bonded to the top surface of a solid metal disc 17.

As the disc 13 is rotated, the coins deposited on the top surface thereof tend to slide outwardly over the surface of the pad 16 due to centrifugal force. As the coins move outwardly, those coins which are lying flat on the pad 16 enter the gap between the pad surface and the sorting head 12 because the underside of the inner periphery of the sorting head is spaced above the pad 16 by a distance which is approximately as great as the thickness of the thickest coin. As further described below, the coins are sorted into their respective denominations, and the coins for each denomination issue from a respective exit slot, such as the slots 20, 21, 22, 23, 24 and 25. The particular embodiment illustrated in FIG. 2 was specifically designed for handling six Australian coins, i.e., all the Australian coins except the one-cent and two-cent coins.

Figure 2:
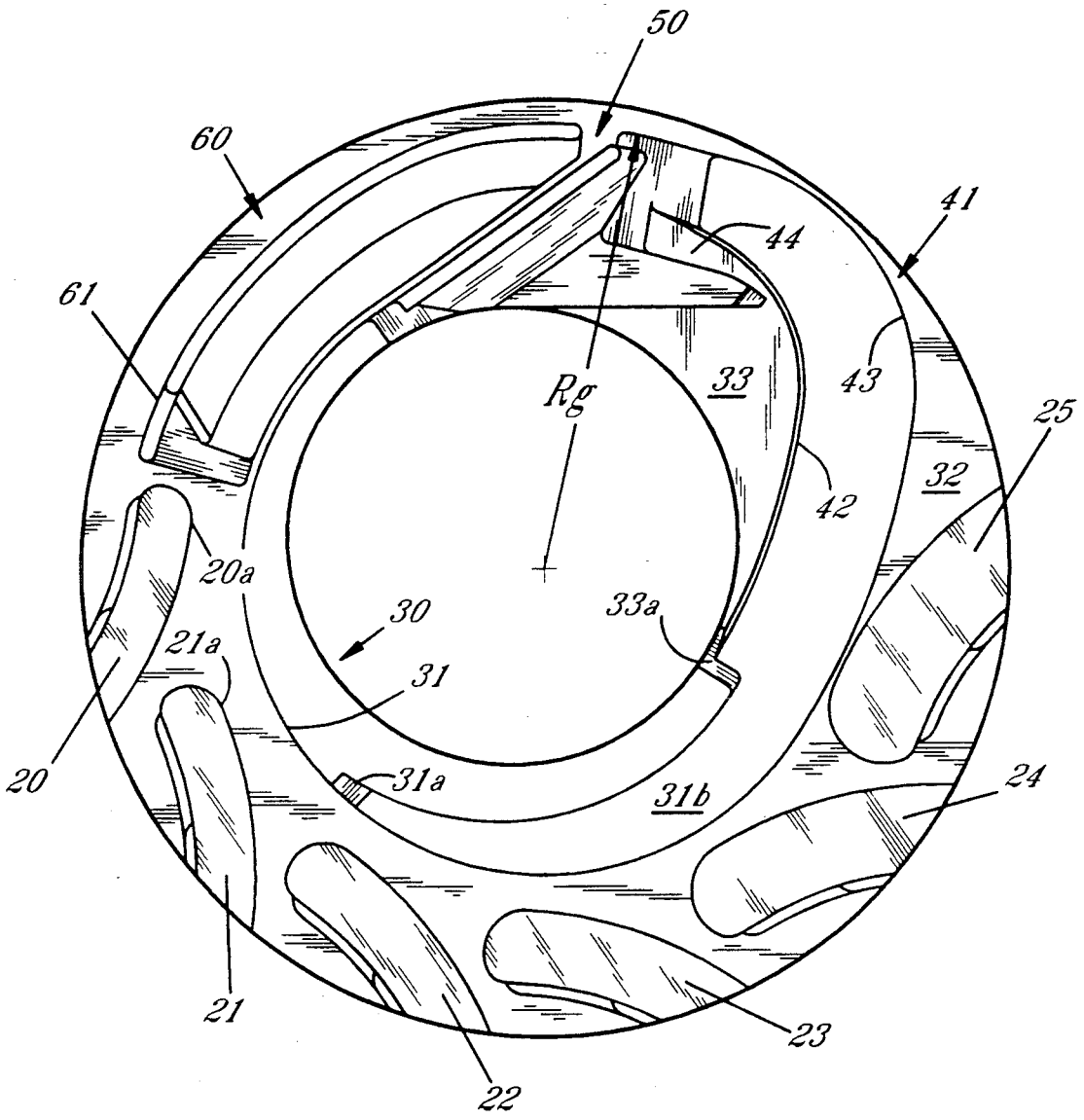
FIG. 2 is an enlarged bottom plan view of the sorting head or guide plate in the coin sorter of FIG. 1.
Figure 3:
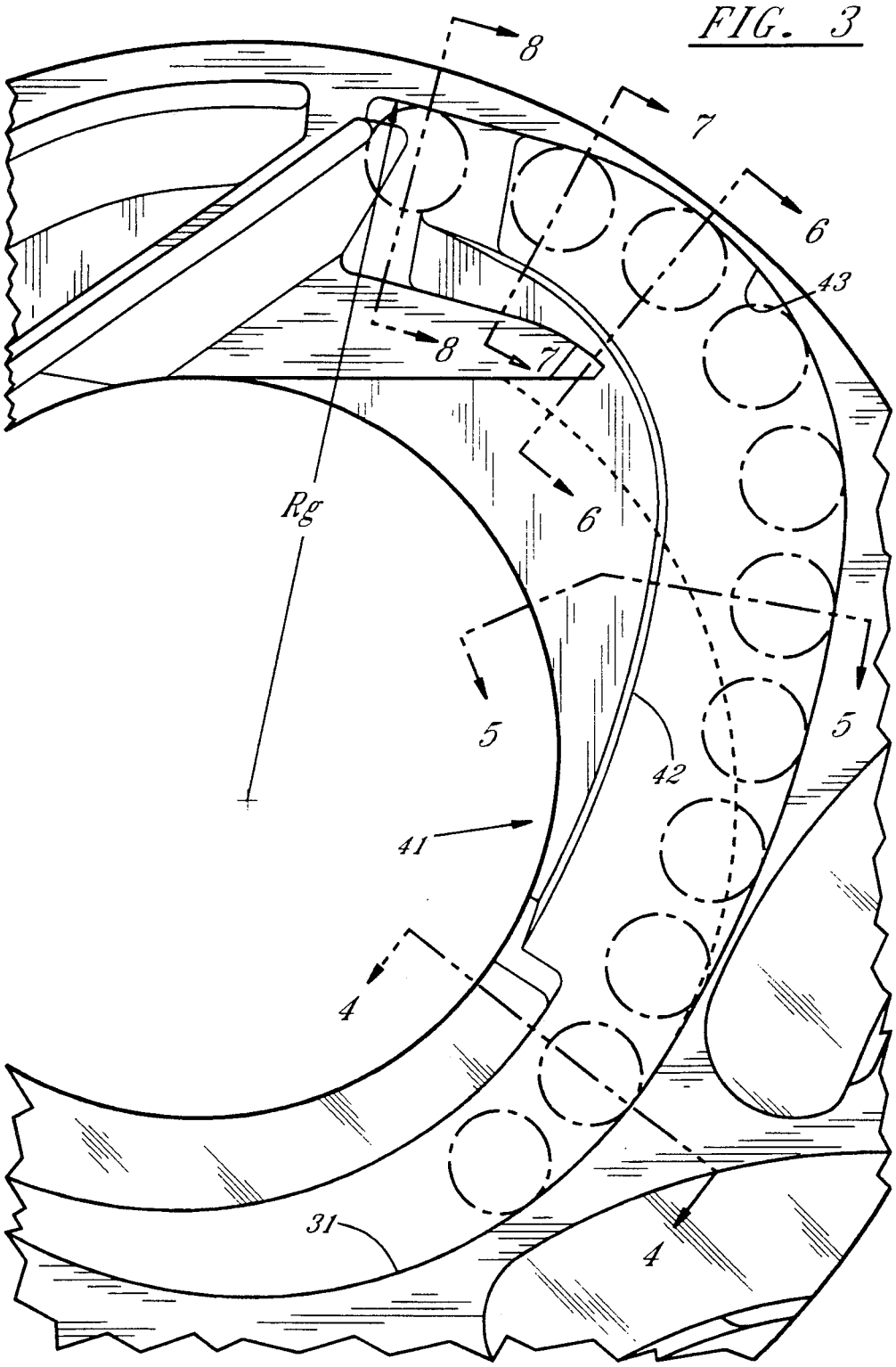
FIG. 3 is an enlarged view of the right-hand portion of FIG. 2, with various coins superimposed thereon.
Figure 4:
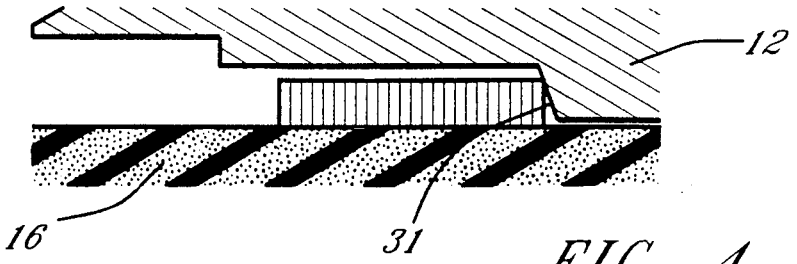
FIG. 4 is an enlarged section taken generally along line 4—4 in FIG. 3, showing the coins in full elevation.
Figure 5:
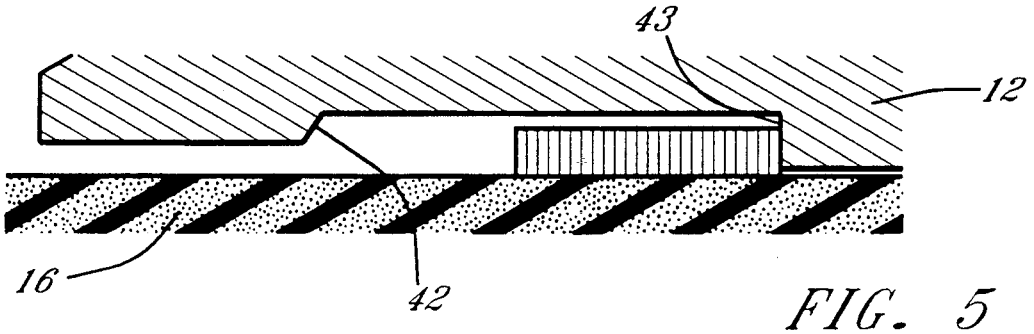
FIG. 5 is an enlarged section taken generally along line 5—5 in FIG. 3, showing the coins in full elevation.
Figure 6:
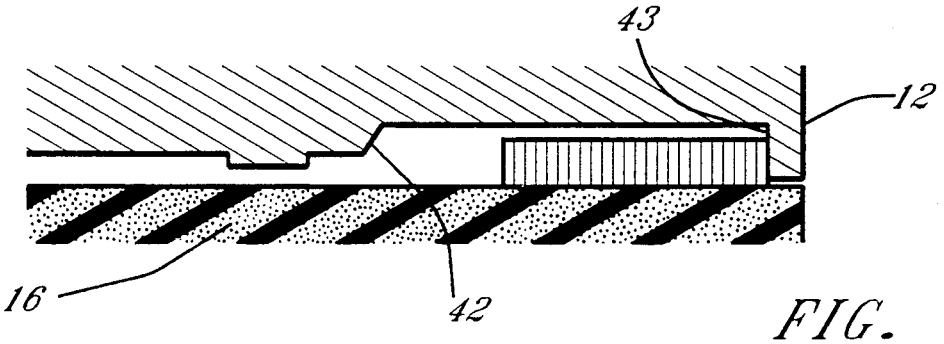
FIG. 6 is an enlarged section taken generally along line 6—6 in FIG. 3, showing the coins in full elevation.
Figure 7:
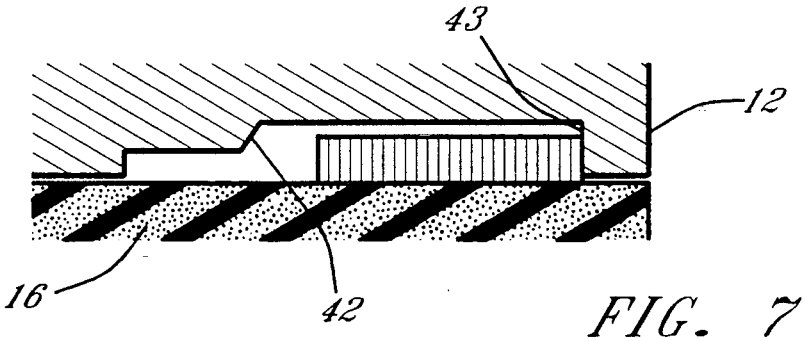
FIG. 7 is an enlarged section taken generally along line 7—7 in FIG. 3, showing the coins in full elevation.
Figure 8:
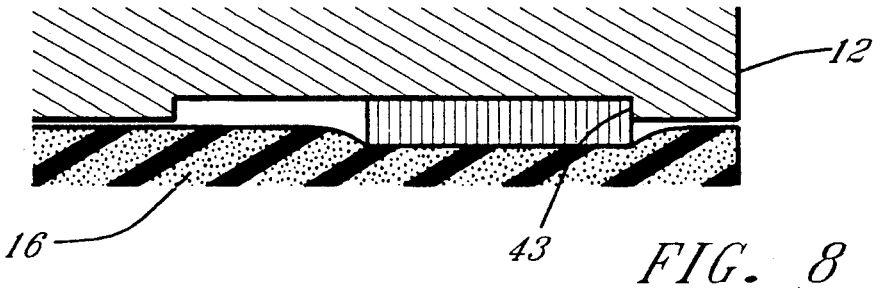
FIG. 8 is an enlarged section taken generally along line 8—8 in FIG. 3, showing the coins in full elevation.

As can be seen most clearly in FIG. 2, the outwardly moving coins initially enter the entry region 30 formed in the underside of the sorting head 12 and extending around a major portion of the inner periphery of the sorting head. The outer wall 31 of the entry region 30 extends downwardly to the lowermost surface 32 of the sorting head, which is preferably spaced from the top surface of the pad 16 by a distance, e.g., 0.010 inch, which is slightly less than the thickness of the thinnest coins. Consequently, the initial radial movement of the coins is terminated when they engage the wall 31 of the region 30, though the coins continue to move circumferentially along the wall 31 by the rotational movement of the pad 16.

As the disc 13 rotates, thick coins in the recess 30 that are next to the wall 31 engage a ramp 31*a* which presses the coins into the pad 16; thereafter their radial position is fixed by pressure between the pad 16 and a surface 31*b*. Thick coins which fail to initially engage the ramp 31*a*, engage a wall along the inner edge of the ramp 31*a* and the surface 31*b* and are recirculated back into the feed opening of the sorting head. This prevents misaligned thick coins from hindering the flow of coins to the spiral channel 41.

The only portion of the central opening of the guide plate 12 which does not open directly into the recess 30 is that sector of the periphery which is occupied by a land 33 whose lower surface is at a slightly higher elevation than the lowermost surface 32 of the sorting head. The upstream end of the land 33 forms a ramp 33*a* (FIG. 2). When a coin has only partially entered the entry region 30, it engages the ramp 33*a* on the leading edge of the land 33. The ramp 33*a* presses the coin downwardly into the resilient pad 16, which causes the coin to be recirculated.

Coins which clear the ramp 33*a* enter the spiral channel 41 which guides the coins to the gaging channel 60. A recycling channel 50 is provided at the outlet of the channel 41 for recycling coins which do not have their outer edges close to the outer wall of the channel 41.

The spiral channel 41 causes coins of different thicknesses and/or diameters to follow different paths which facilitate the queuing of the coins and increase the coin throughput rate. Though following different paths, the coins of all denominations exit the spiral channel 41 with a common edge (the outer edges of all coins) aligned at the same or approximately the same radial position so that the opposite (inner) edges of the coins can be used for sorting.

The spiral channel 41 is deeper than the thinner coins, such as the 5-cent and 10-cent coins in the Australian coin set, but shallow enough to press the thicker coins into the resilient pad 16. A deeper channel would not provide the desired queuing of coins within the spiral channel, such as the stripping action to be described below, and would allow the thin coins to bounce around within the channel. Coins of different thicknesses and/or diameters follow different paths within the spiral channel 30, and these different paths have been separately illustrated in FIGS. 3-8, 9-14, 15-20, 21-26 and 27-32.

Referring first to FIGS. 3-8, these figures illustrate the path followed by small, thin coins in a single layer. These are coins having a diameter smaller than the width of the channel between the inner wall 42 and the outer wall 43 at the exit end of the channel, and thin enough to avoid being pressed into the resilient pad. These coins are normally, already against the wall 31 when they enter the spiral channel 41, and are guided through the entire length of the channel by the outer wall 43, exiting with their outer edges at the desired gaging radius $R_g$.

Figure 9:
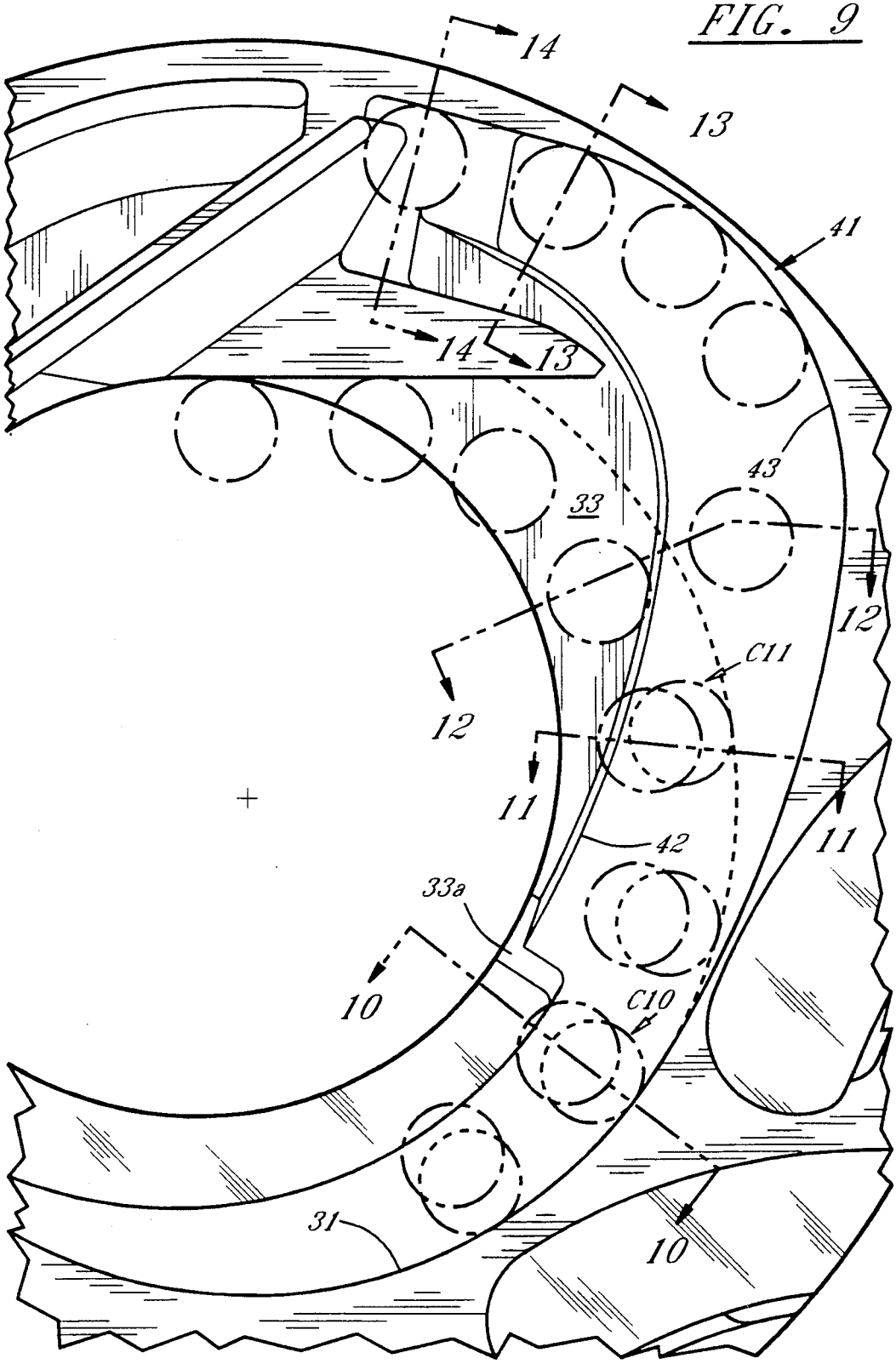
FIG. 9 is an enlarged view of the right-hand portion of FIG. 2, with various coins superimposed thereon.
Figure 10:
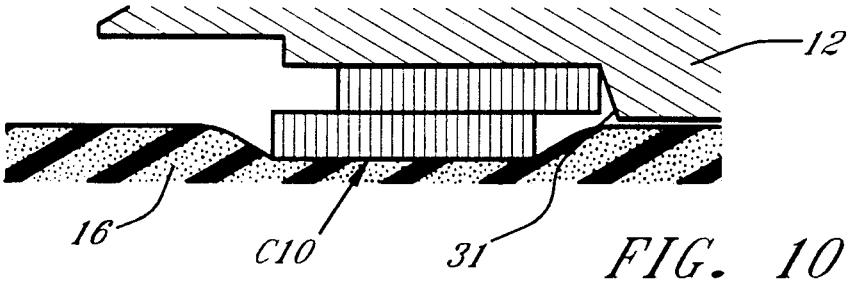
FIG. 10 is an enlarged section taken generally along line 10—10 in FIG. 9, showing the coins in full elevation.
Figure 11:
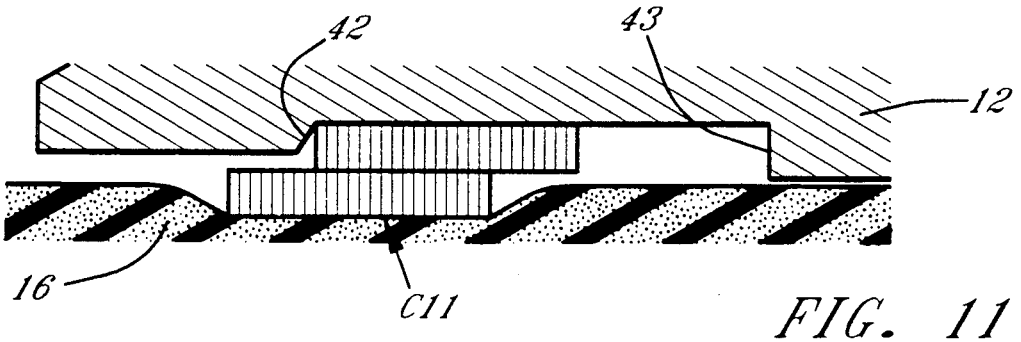
FIG. 11 is an enlarged section taken generally along line 11—11 in FIG. 9, showing the coins in full elevation.
Figure 12:
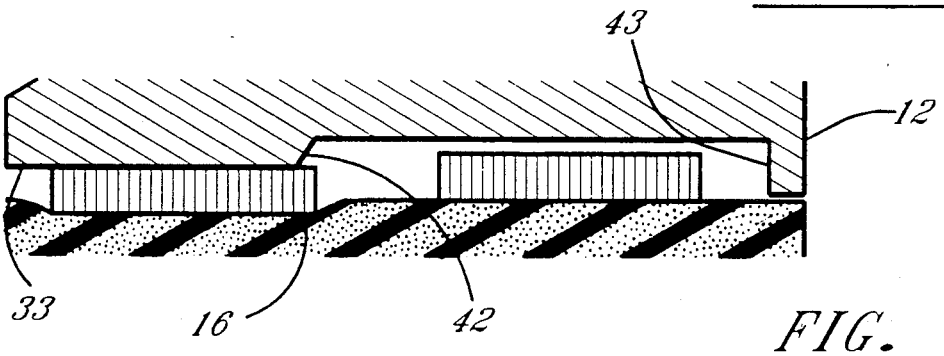
FIG. 12 is an enlarged section taken generally along line 12—12 in FIG. 9, showing the coins in full elevation.
Figure 13:
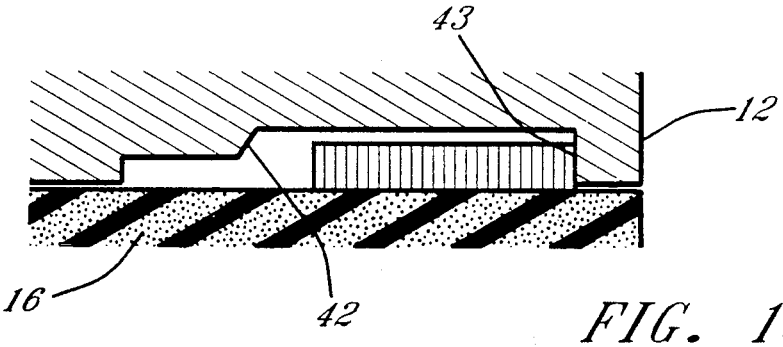
FIG. 13 is an enlarged section taken generally along line 13—13 in FIG. 9, showing the coins in full elevation.
Figure 14:
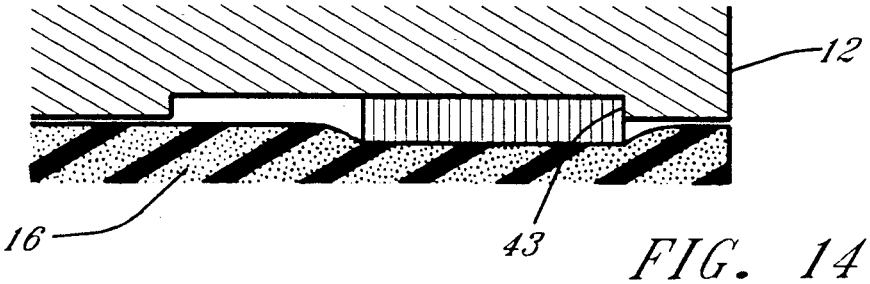
FIG. 14 is an enlarged section taken generally along line 14—14 in FIG. 9, showing the coins in full elevation.
Figure 15:
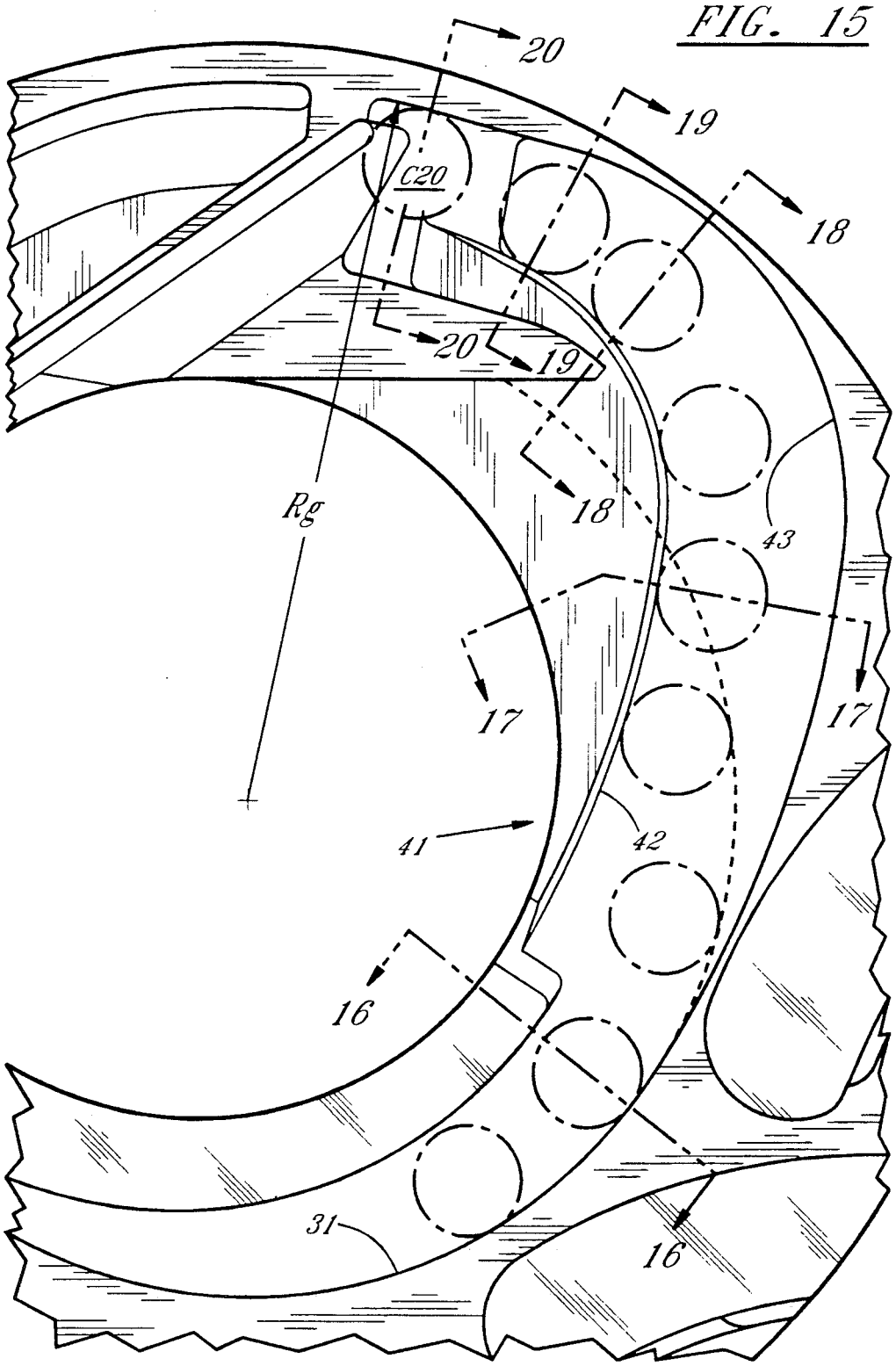
FIG. 15 is an enlarged view of the right-hand portion of FIG. 2, with various coins superimposed thereon.
Figure 16:
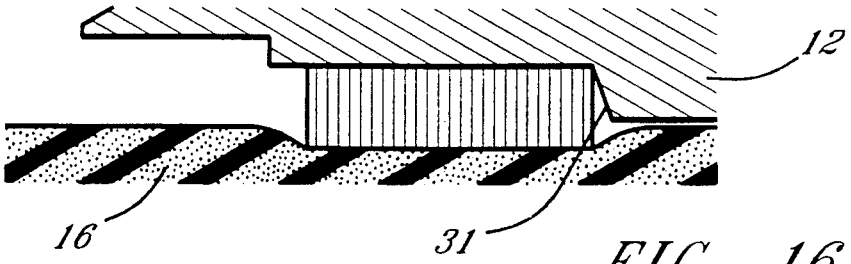
FIG. 16 is an enlarged section taken generally along line 16—16 in FIG. 15, showing the coins in full elevation.
Figure 17:
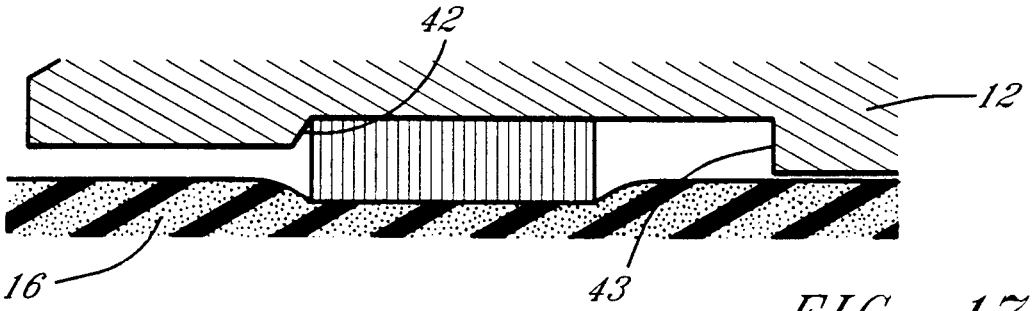
FIG. 17 is an enlarged sectin taken generally along line 17—17 in FIG. 15, showing the coins in full elevation.
Figure 18:
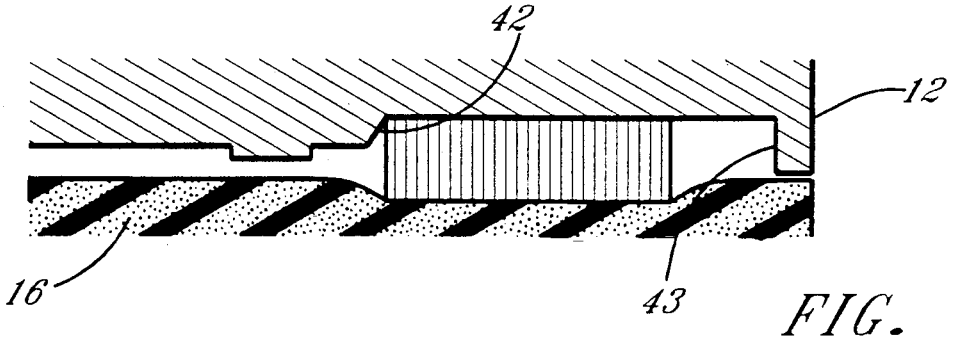
FIG. 18 is an enlarged section taken generally along line 18—18 in FIG. 15, showing the coins in full elevation.

The illustrative spiral channel 41 strips apart stacked or shingled coins, as illustrated in FIGS. 9-14. In general, the combined thickness of a pair of stacked or shingled coin is great enough to cause the lower coin in that pair to be pressed into the resilient pad. Consequently, that pair of coins will be rotated concentrically with the disc, as illustrated by the coin pairs C10 and C11 in FIGS. 9-11. Because the inner wall 42 spirals outwardly, the upper coin will eventually engage the tapered inner wall 42, as illustrated in FIG. 11, and the lower coin, as also illustrated in FIG. 11, will pass under that wall 42 (see FIG. 12). As shown in FIG. 9, the latter coin will be recirculated back to the entry region of the sorting head and will later re-enter the spiral channel. The preferred taper of the wall 42 is about 35°.

Small, thick coins follow the path illustrated in FIGS. 15–20. The thickness of these coins is greater than the distance between the channel ceiling and the resilient pad, as a result of which the coins are pressed into the resilient pad (see FIG. 16). Consequently, these coins are not free to follow the outer wall 43 as it spirals outwardly, but rather move concentrically with the disc until they engage the inner wall 42 (see FIGS. 16 and 17). They are then guided by the inner wall 42 which guides the coins outwardly until their outer edges engage the outer wall 43 as it converges with the inner wall 42. In the illustrative embodiment, the convergence of the inner and outer walls 42 and 43 is effected by progressively reducing the radius of the outer wall 43 near the outlet of the spiral channel 41, but it will be appreciated that an alternative would be to continue increasing the radius of the inner wall 42 while maintaining the radius of the outer wall 43 constant after it reaches its maximum radius. Whichever technique is used, the inner and outer walls 42 and 43 must converge enough to bring the outer edges of the small-diameter, thick coins into engagement with the outer wall 43 so as to position the outer edges of such coins at the desired gaging radius $R_g$.

Figure 19:
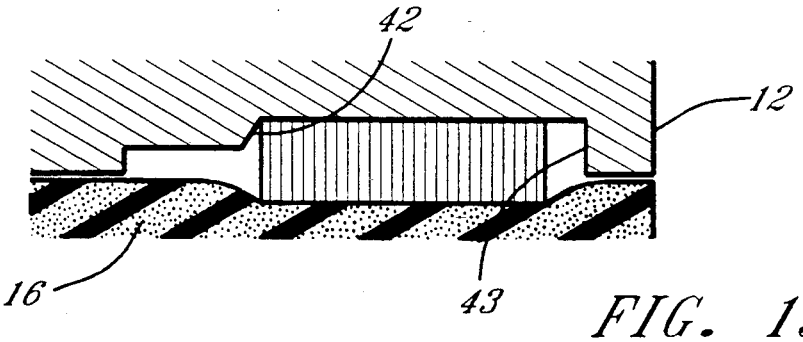
FIG. 19 is an enlarged section taken generally along line 19—19 in FIG. 15, showing the coins in full elevation.
Figure 20:
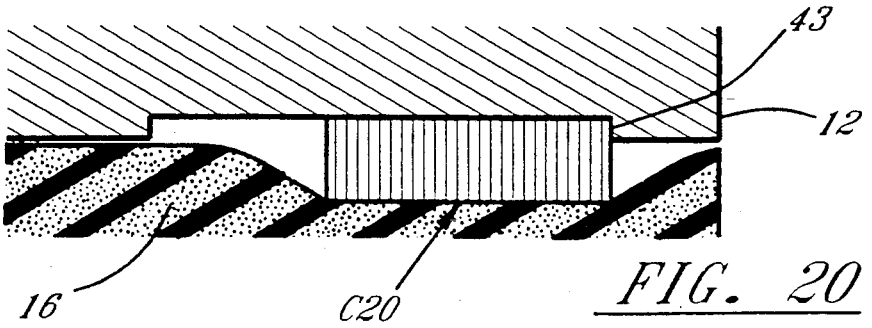
FIG. 20 is an enlarged section taken generally along line 20—20 in FIG. 15, showing the coins in full elevation.
Figure 21:
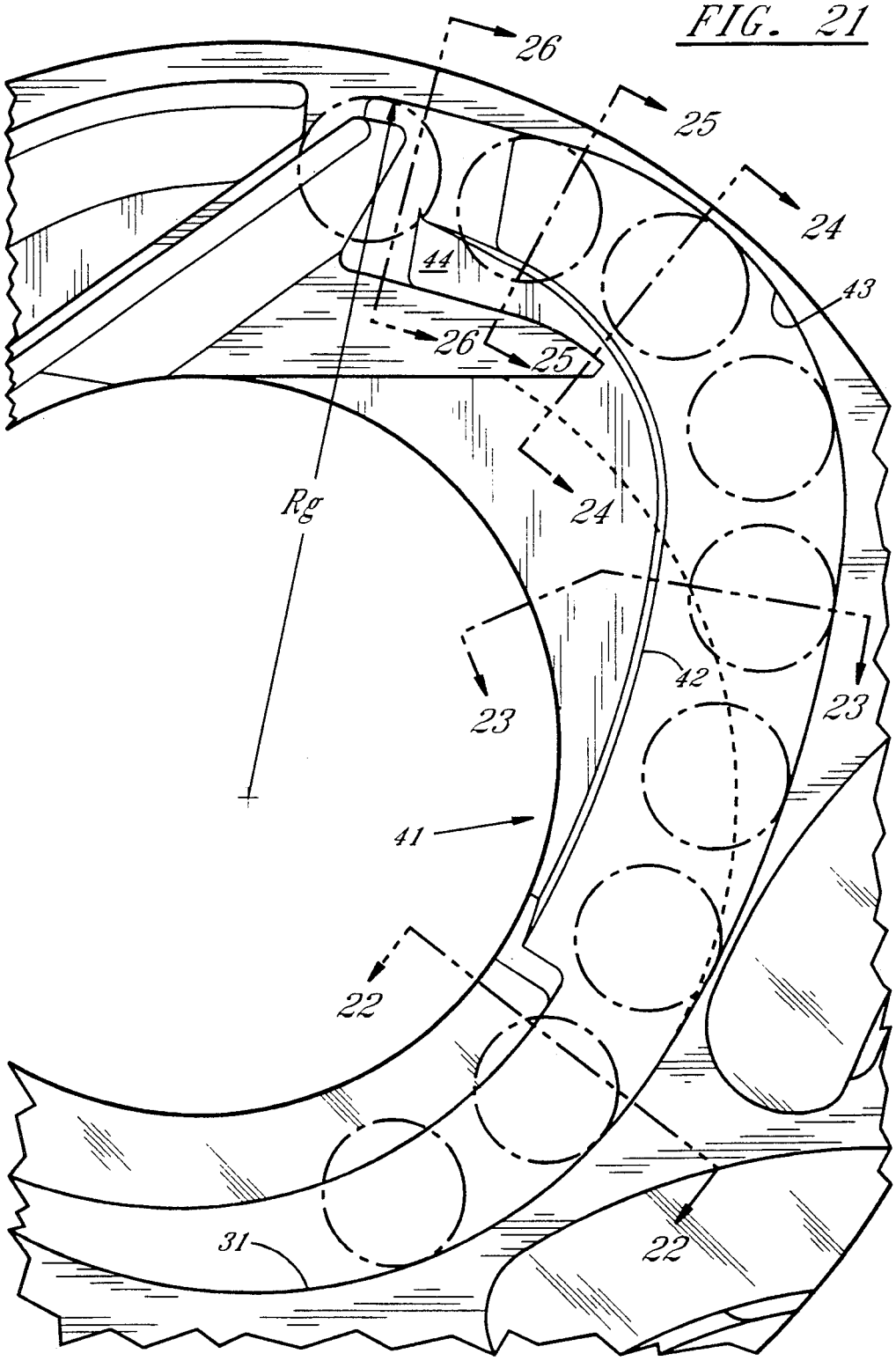
FIG. 21 is an enlarged view of the right-hand portion of FIG. 2, with various coins superimposed thereon.
Figure 22:
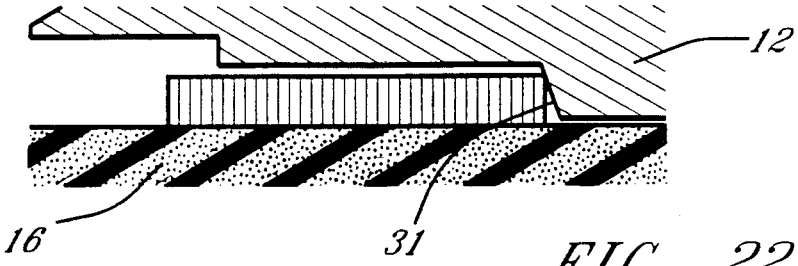
FIG. 22 is an enlarged section taken generally along line 22—22 in FIG. 21, showing the coins in full elevation.
Figure 23:
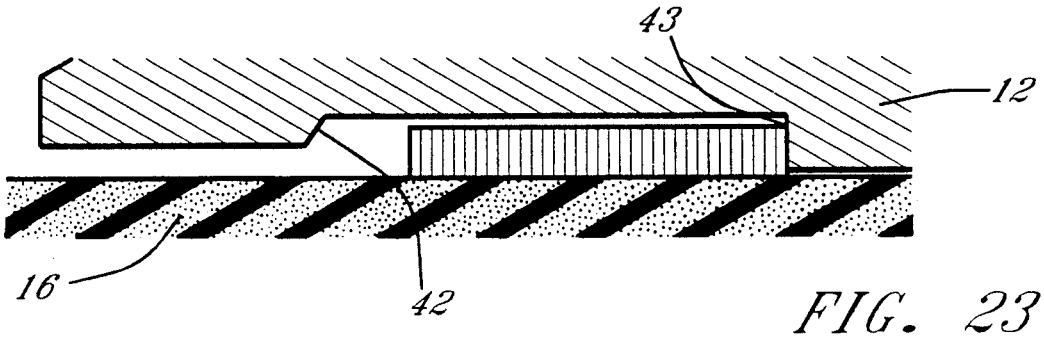
FIG. 23 is an enlarged section taken generally along line 23—23 in FIG. 21, showing the coins in full elevation.
Figure 24:
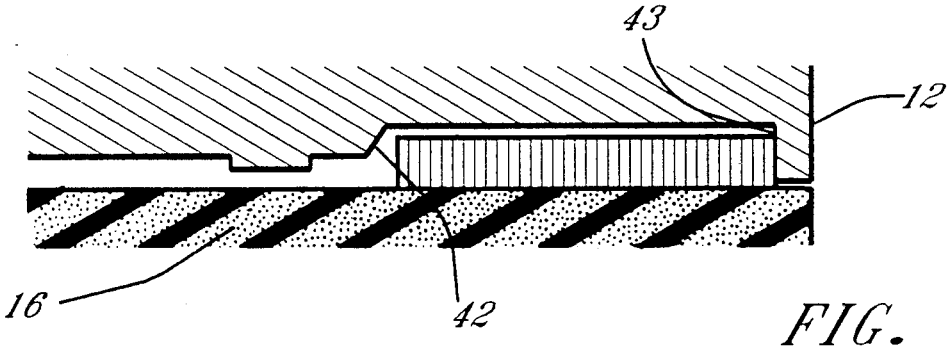
FIG. 24 is an enlarged section taken generally along line 24—24 in FIG. 21, showing the coins in full elevation.
Figure 25:
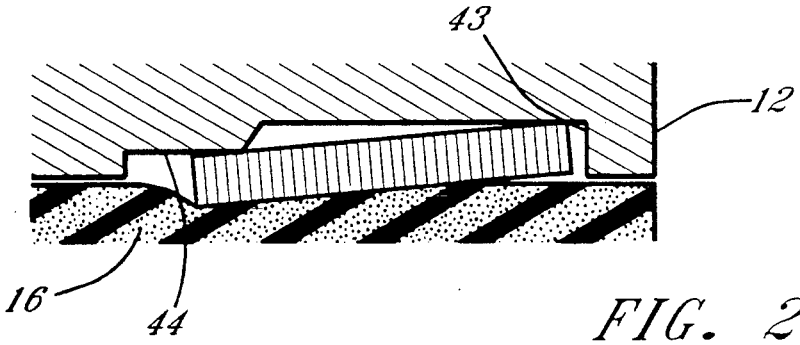
FIG. 25 is an enlarged section taken generally along line 25—25 in FIG. 21, showing the coins in full elevation.
Figure 26:
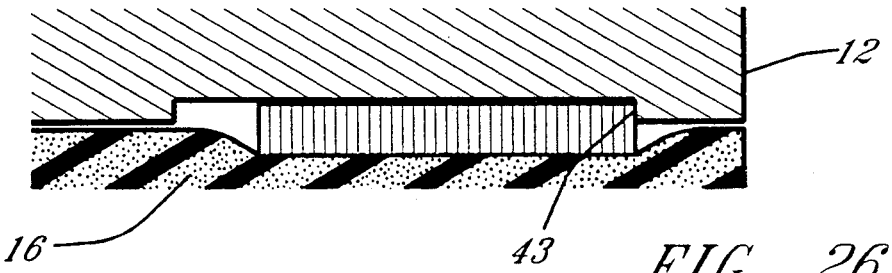
FIG. 26 is an enlarged section taken generally along line 26—26 in FIG. 21, showing the coins in full elevation.
Figure 27:
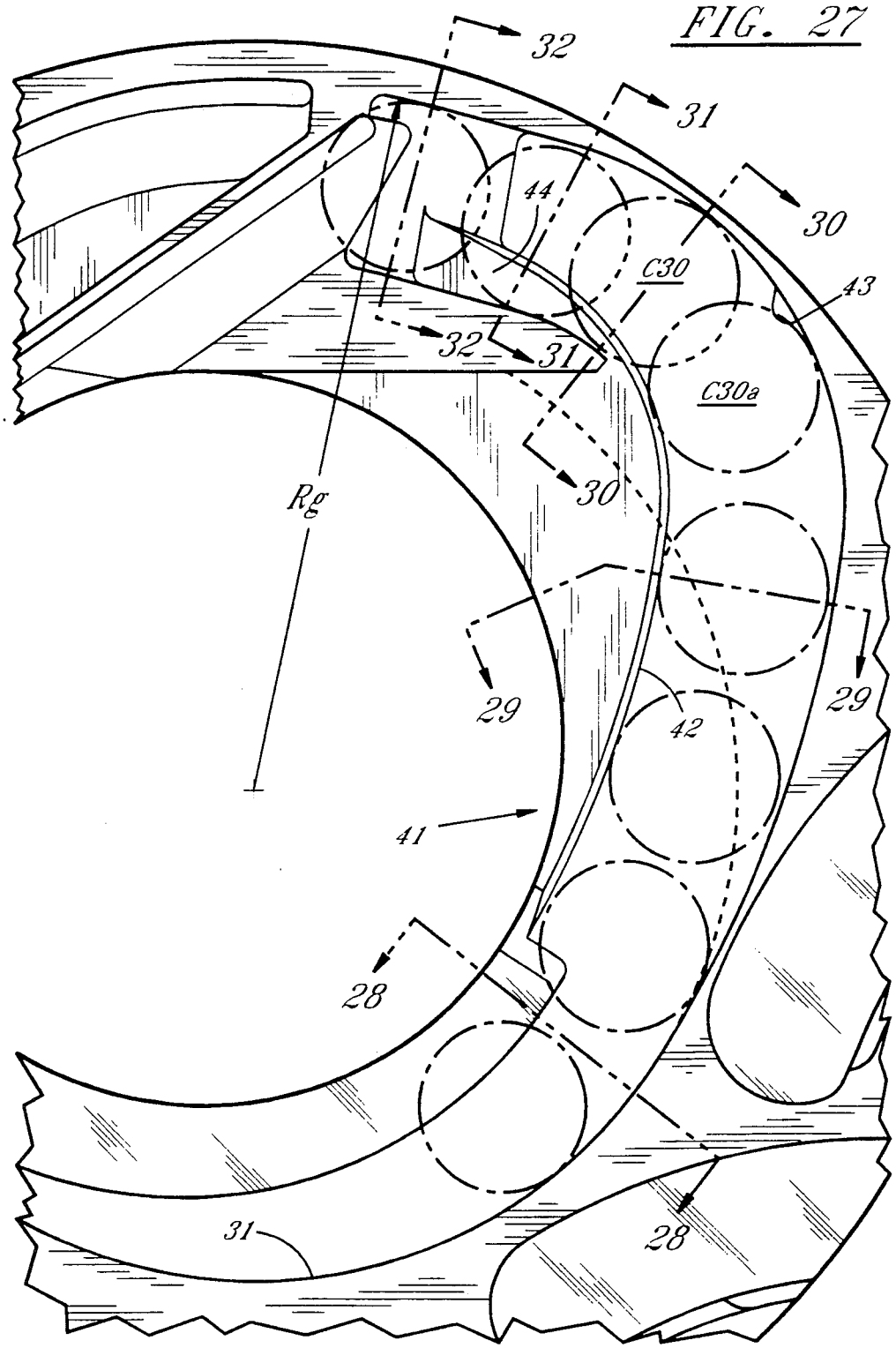
FIG. 27 is an enlarged view of the right-hand portion of FIG. 2, with various coins superimposed thereon.
Figure 28:
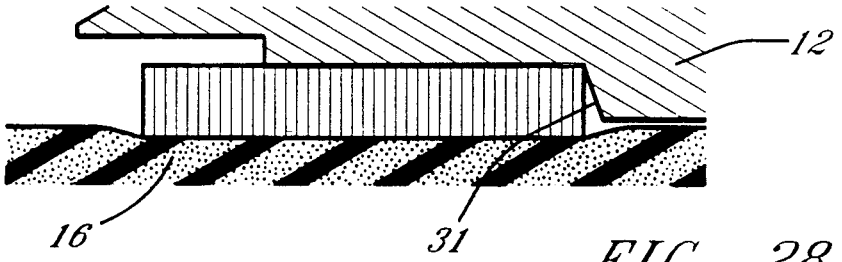
FIG. 28 is an enlarged section taken generally along line 28—28 in FIG. 27, showing the coins in full elevation.
Figure 29:
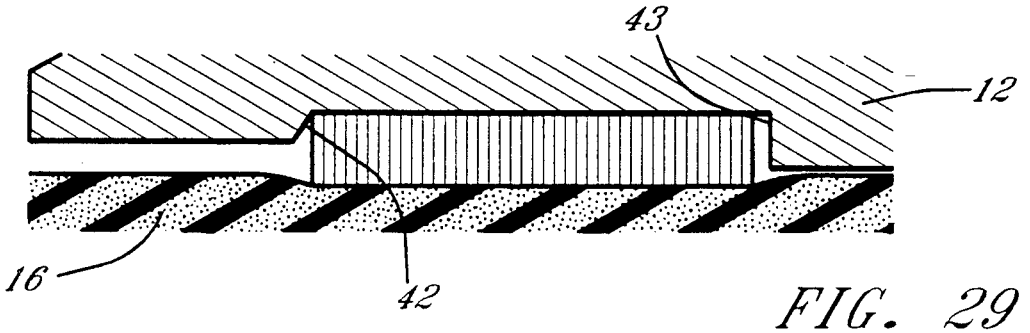
FIG. 29 is an enlarged section taken generally along line 29—29 in FIG. 27, showing the coins in full elevation.
Figure 30:
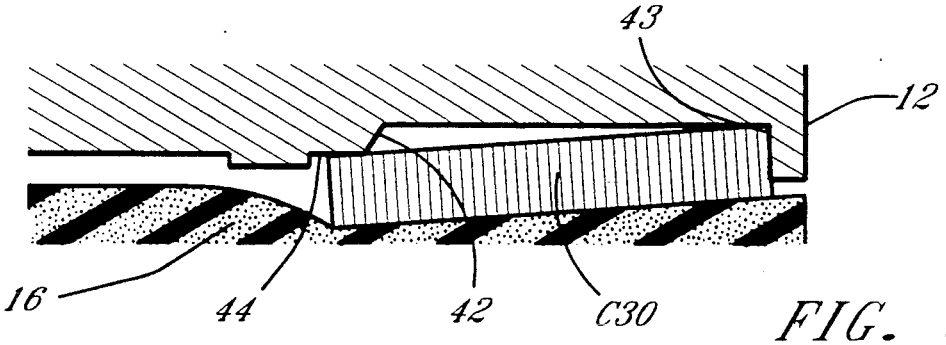
FIG. 30 is an enlarged section taken generally along line 30—30 in FIG. 27, showing the coins in full elevation.
Figure 31:
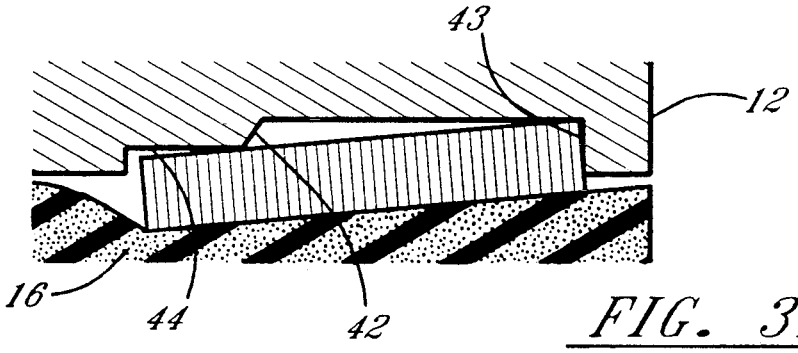
FIG. 31 is an enlarged section taken generally along line 31—31 in FIG. 27, showing the coins in full elevation.
Figure 32:
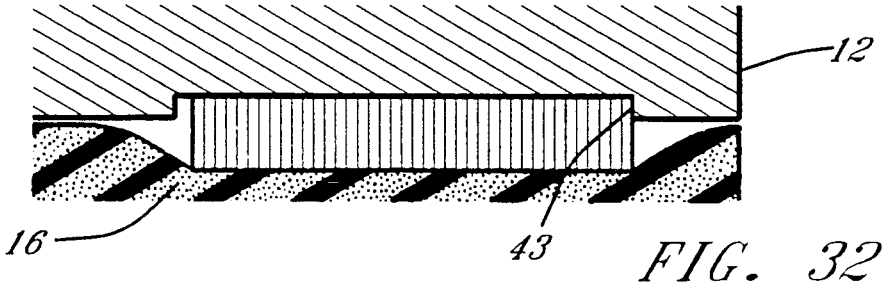
FIG. 32 is an enlarged section taken generally along line 32—32 in FIG. 27, showing the coins in full elevation.

The minimum distance between the inner and outer walls 42 and 43, i.e., at the location of coin C20 in FIG. 20, is about the same as the diameter of the smallest coin that is thick enough to be pressed into the resilient pad in the channel region between the inner and middle walls. Consequently, when such a coin reaches the point where that distance is a minimum, the outer edge of the coin is adjacent the outer wall 43, as shown in FIGS. 19 and 20. Thus the small, thick coins exit the channel 41 with the outer edges of the coins at the gaging radius $R_g$.

Larger-diameter thin coins follow the outer wall 43 of the spiral channel 41, as illustrated in FIGS. 21–26, in the same manner as the small-diameter thin coins. At the outlet end of the spiral channel 41, however, the radial distance between the inner and outer walls 42 and 43 becomes smaller than the diameter of the larger, thin coins. Thus, to allow these large coins to exit from the spiral channel 41 with their outer edges at the desired gaging radius $R_g$, the region 44 inboard of the inner wall 42 is relieved so that the inner portions of such coins can pass under the wall 42. The outer edges of those coins then continue to follow the outer wall 43.

Thick coins which have a diameter greater that the minimum distance between the inner and outer walls 42 and 43 follow the path shown in FIGS. 27–32. Because these coins are pressed into the resilient pad, they are rotated concentrically with the disc until the inner edges of the coins engage the inner wall 42 (see FIG. 28). These coins are then guided by the inner wall 42 until the outer edges of the coins engage the outer wall 43 (coin C30*a*). At that point the inner portions of such coins pass beneath the inner wall 42 and ride along the relieved region 44 (coin C30).

It can occur that correctly aligned coins passing under the recycling channel 50 can be slightly shifted in their radial position. To correct this, coins which pass the recycling channel 50 enter the gaging channel 60 which allows the coins to be realigned against the radially outer wall 61. The channel 60 and wall 61 allow the coins in the sorting path an opportunity to realign their outer edges at the radial position required for correct sorting. To ensure that every coin engages the wall 61, the radius of the wall 61 from the center of the disc is gradually decreased along the length of the channel 60.

Beyond the gaging channel 60, the sorting head 12 forms the series of exit channels 20, 21, 22, 23, 24 and 25 which function as selecting means to discharge coins of different denominations at different circumferential locations around the periphery of the sorting head. Thus, the channels 20–25 are spaced circumferentially around the outer periphery of the sorting head 12, with the innermost edges of successive channels located progressively farther away from the common radial location of the outer edges of all coins for receiving and ejecting coins in order of increasing diameter. In the particular embodiment illustrated, the six channels 20–25 are positioned and dimensioned to eject successively the 5-cent Australian coin (channel 20), the 2-dollar Australian coin (channel 21), the 10-cent Australian (channel 22), the 1-dollar Australian coin (channel 23), the 20-cent Australian coin (channel 24) and the 50-cent Australian coin (channel 25). The innermost edges of the exit channels 20–25 are positioned so that the inner edge of a coin of only one particular denomination can enter each channel; the coins of all other denominations reaching a given exit channel extend inwardly beyond the innermost edge of that particular channel so that those coins cannot enter the channel and, therefore, continue on to the next exit channel.

For example, the first exit channel 20 is intended to discharge only the 5-cent Australian coin, and thus the innermost edges 20*a* of this channel is located at a radius that is spaced inwardly from the radius of the gaging wall 61 by a distance that is only slightly greater than the diameter of that coin. Consequently, only the 5-cent coins can enter the channel 20. Because the outer edges of all denominations of coins are located at the same radial position when they leave the gaging channel 60, the inner edges of all denominations other than the 5-cent coins extend inwardly beyond the innermost edge 20*a* of the channel 20, thereby preventing those coins from entering that particular channel.

Of the coins that reach channel 21, the inner edges of only the 2-dollar Australian coins are located close enough to the periphery of the sorting head 12 to enter that exit channel. The inner edges of all other denominations extend inwardly beyond the innermost edge 21*a* of the channel 21 so that they remain gripped between the sorting head and the resilient pad. Consequently, such coins are rotated past the channel 21 and continue on to the next exit channel.

Similarly, only the 10-cent Australian coins can enter the channel 22, only the 1-dollar Australian coins can enter the channel 23, only the 20-cent Australian coins can enter the channel 24, and only the 50-cent Australian coins can enter the channel 25.

I claim:

1. A coin sorter comprising a rotatable disc, means for rotating said disc, a stationary sorting head having a lower surface parallel to the upper surface of said rotatable disc and spaced slightly therefrom, the lower surface of said sorting head forming a channel for receiving coins passing beneath the inner edge of the sorting head and guiding those coins as the coins are carried along the lower surface of the sorting head by the rotating disc, said channel having an outer wall which extends outwardly away from the center of rotation of said disc, and then returns inwardly toward said center of rotation for a short distance before terminating at a predetermined gaging radius for the outer edges of the coins to be sorted, and an inner wall which converges toward said outer wall in the region where said outer wall returns toward said center of rotation and prior to the termination of said outer wall at said predetermined gaging radius.

2. The coin sorter of claim 1 wherein the radius of said inner wall from said center of rotation increases in the direction of coin movement, and then remains constant to converge toward the returning portion of said outer wall.

3. The coin sorter of claim 1 wherein said inner wall is beveled to allow coins to be forced under that wall.

4. The coin sorter of claim 1 wherein said inner and outer walls converge to a minimum radial spacing that is substantially equal to the diameter of the smallest-diameter coin having a thickness greater than the vertical distance between said disc and the ceiling of said channel.

5. A coin sorter comprising a rotatable disc, means for rotating said disc, a stationary sorting head having a lower surface parallel to the upper surface of said rotatable disc and spaced slightly therefrom, the lower surface of said sorting head forming a channel for receiving coins passing beneath the inner edge of the sorting head and guiding those coins as the coins are carried along the lower surface of the sorting head by the rotating disc, said channel having an outer wall which extends outwardly away from the center of rotation of said disc, and then returns inwardly toward said center of rotation for a short distance before terminating, and an inner wall which converges toward said outer wall in the region where said outer wall returns toward said center of rotation, the region adjacent said inner wall in the region where said inner and outer walls converge being relieved to receive the inner portions of coins having a diameter greater than the distance between said inner and outer walls.

* * * * *